US009347442B1

(12) United States Patent
Gostomski

(10) Patent No.: US 9,347,442 B1
(45) Date of Patent: May 24, 2016

(54) FLUID TRANSFER HAND PUMP

(71) Applicant: Richard B. Gostomski, Thorp, WI (US)

(72) Inventor: Richard B. Gostomski, Thorp, WI (US)

( * ) Notice: Subject to any disclaimer, the term of this patent is extended or adjusted under 35 U.S.C. 154(b) by 0 days.

(21) Appl. No.: 14/736,506

(22) Filed: Jun. 11, 2015

(51) Int. Cl.
*F04B 35/01* (2006.01)
*F04B 39/00* (2006.01)

(52) U.S. Cl.
CPC ..... *F04B 35/01* (2013.01); *F04B 39/0005* (2013.01)

(58) Field of Classification Search
CPC .... F04B 33/00; F04B 33/005; F04B 39/0005; F04B 35/01; F04B 5/02; F04B 25/005; F04F 1/00; F04F 1/06; F04F 1/16; A47J 27/21183; B67D 1/08; B67D 7/60; E03C 1/308; B05B 9/0426
USPC ..... 137/123, 125, 136, 144, 145, 147, 148, 137/150; 222/400.7, 400.8; 417/118
See application file for complete search history.

(56) References Cited

U.S. PATENT DOCUMENTS 2,550,157 A 4/1951 Mazza
2,723,056 A 11/1955 Smith
4,493,443 A * 1/1985 Bailey ..... B67D 1/08 222/400.8
4,972,972 A 11/1990 Goguen
4,997,217 A * 3/1991 Kunze ..... F16L 19/0237 128/202.27
5,332,120 A * 7/1994 D'Andrade ..... B05B 9/0426 222/401
6,017,201 A * 1/2000 Yang ..... F04B 25/005 417/454
6,035,455 A * 3/2000 Rankovic ..... E03C 1/308 4/255.03
7,077,951 B2 * 7/2006 Monteiro ..... A47J 27/21183 210/136
7,740,151 B2 * 6/2010 Stone ..... F04B 33/00 137/212
7,793,801 B2 * 9/2010 Drummond ..... B67D 7/60 141/392
8,047,818 B2 * 11/2011 Sorensen ..... F04B 5/02 417/258
8,272,316 B2 * 9/2012 van der Blom ..... F04B 33/005 92/169.1

* cited by examiner

*Primary Examiner* — Bryan Lettman
*Assistant Examiner* — Connor Tremarche
(74) *Attorney, Agent, or Firm* — Crossley & Stevenson IP Law

(57) ABSTRACT

The fluid transfer hand pump has a first chamber separated from a second chamber by a barrier with air passages. Air is drawn into the first chamber upon elevation of a knobbed rod. Air is forced into the second chamber by plunging the rod with a cupped seal into the first chamber. The second chamber is sealably joined to a fluid containing vessel to pressurize the vessel, which in turn forces fluid out of the pump and into a desired receptacle.

2 Claims, 4 Drawing Sheets

FLUID TRANSFER HAND PUMP

BACKGROUND OF THE INVENTION

Of various know fluid pumps, some are hand operated. Of the current hand operated pumps, many are not capable of sealably affixable attachment to a fluid containing vessel. Also, current hand operated pumps are configured to draw fluid from a vessel and have it exit out of an exit hose. Current hand operated pumps are known for messy use when transferring a fluid from a vessel to a destination. The current fluid transfer hand pump threadably and sealably attaches to a thread topped vessel. The current fluid transfer hand pump pressurizes the vessel to force fluid out of the vessel into a second tubing, which is in operational communication with a first tubing, and hence to a desired destination. The first tubing is fitted with a one-way valve to prevent fluid backflow into the vessel.

FIELD OF THE INVENTION

The present fluid transfer hand pump relates to fluid pumps, and more particularly, to a hand operated fluid transfer hand pump that pressurizes a fluid containing vessel.

SUMMARY OF THE INVENTION

The general purpose of the fluid transfer hand pump, described subsequently in greater detail, is to provide a fluid transfer hand pump that has many novel features that result in a fluid transfer hand pump which is not anticipated, rendered obvious, suggested, or even implied by prior art, either alone or in combination thereof.

To accomplish this, the fluid transfer hand pump has a tube having a closed top end spaced apart from an open bottom end. An outward flange is disposed on the open bottom end. A first chamber is disposed within the tube proximal the closed top end. A second chamber is disposed within the tube proximal the open bottom end. A barrier divides the first chamber from the second chamber. A plurality of air passages is disposed within the barrier.

A rubberized grommet is disposed on the outward flange. At least one vent is disposed in the closed top end. A first groove is disposed within the first chamber adjacent the closed top end. An air filter is selectively disposed within the first chamber adjacent the first groove. The vent and the air filter are in operational communication with the first chamber. A guide is selectively disposed within the first chamber adjacent the air filter. A second groove is disposed between the air filter and the guide. A third groove is disposed adjacent the selectively present guide and distal the closed top end. Of a plurality of snap rings provided, one of each snap ring is disposed within each of the first groove, the second groove, and the third groove, wherein the air filter and the guide are configured to be removably retained.

A knobbed rod is slidably disposed through the closed top end, the air filter, and the selectively present guide. The knobbed rod has a distal end disposed through the closed top end and a proximal end disposed within the first chamber. A first disc is disposed on the proximal end. A first cupped seal is disposed adjacent the disc. The first cupped seal faces the open bottom end. The first cupped seal is slidable within the first chamber. A first retainer selectively retains the first cupped seal and the first disc to the knobbed rod. The knobbed rod is also provided with the first disc and the first cupped seal bonded to the proximal end.

A shoulder is disposed on the barrier within the first chamber. A second disc is disposed atop the shoulder. A second cupped seal is disposed between the second disc and the shoulder. The second cupped seal faces the barrier. A second retainer selectively retains the second disc and the second cupped seal to the shoulder. A sleeve is disposed continuously from the barrier to the open bottom end. A collar is disposed between the sleeve and the tube. A hollow fitting is disposed within the collar. The hollow fitting is selectively provided as removable, with a threaded end spaced apart from a second end by an external lip. The threaded end is disposed within the collar. The external lip is selectively abutted to the tube. When not removable, the hollow fitting is permanently attached to the collar.

A flexible first tubing is fitted to the second end. A one-way valve is disposed within the flexible first tubing distal the hollow fitting. The one-way valve is configured to prevent a fluid passing the one-way valve from reentering the first tubing.

A threaded coupling has an inward flange slidably engaging the tube and the outward flange. A flexible second tubing is disposed on the sleeve. The threaded coupling is configured to engage a fluid container. The rubberized grommet is configured to seal the second chamber to the fluid container. The second tubing is configured to extend within the fluid container. The second tubing is in operational communication with the first tubing. Forcing the knobbed rod downwardly within the first chamber is configured to capture air with the first cupped seal and pass the air beyond the second cupped seal, through the plurality of air passages, and into the second chamber. The second cupped seal substantially prevents air from reentering the first chamber from the second chamber. The air within the second chamber is configured to create an approximate two pounds per square inch of pressurized air within the container. The pressurized air within the container forces a fluid in the container through the second tubing, the sleeve, the collar, the one-way valve, and out of the first tubing.

Thus has been broadly outlined the more important features of the present fluid transfer hand pump so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
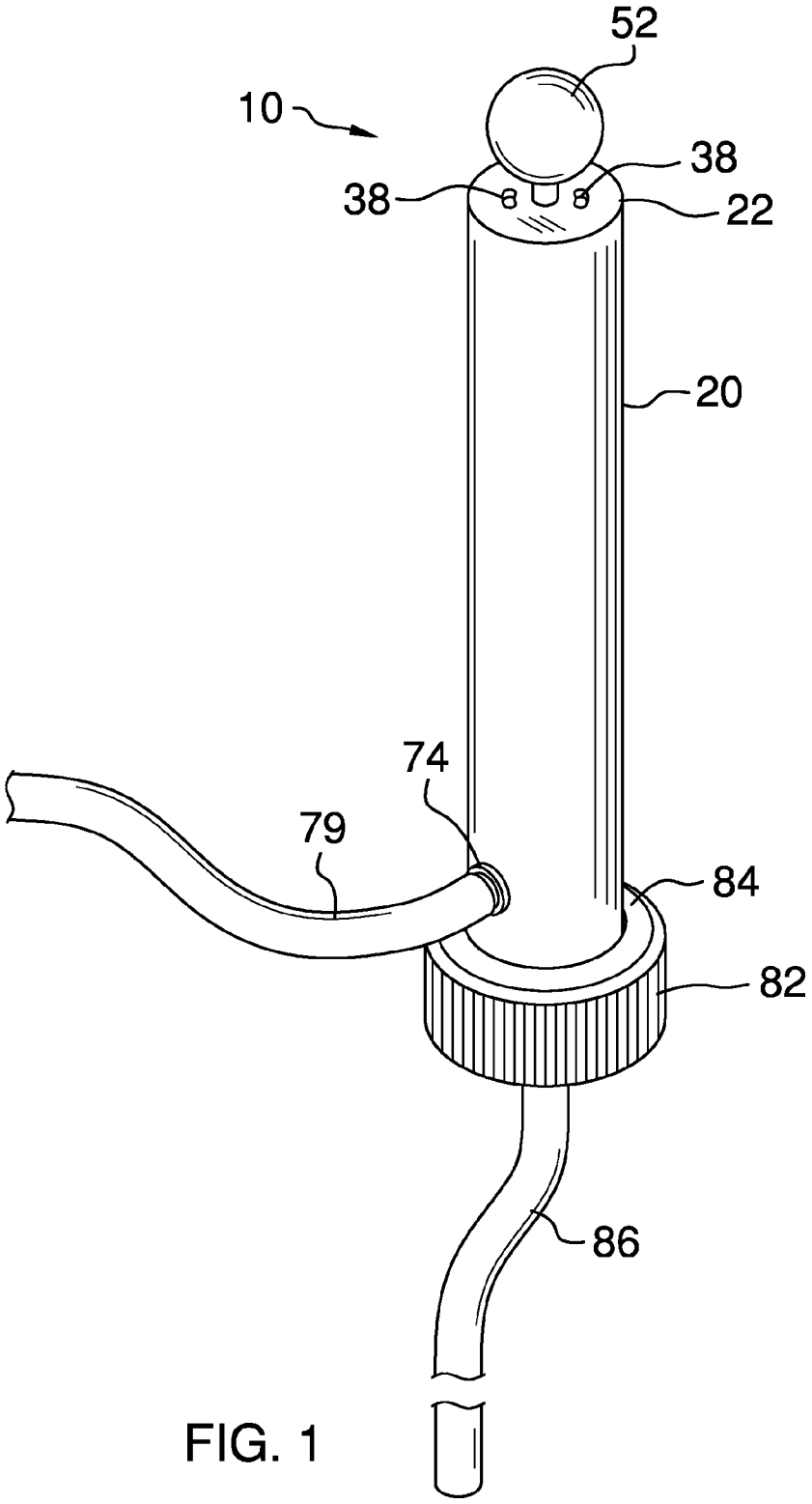
FIG. 1 is a perspective view.
Figure 2:
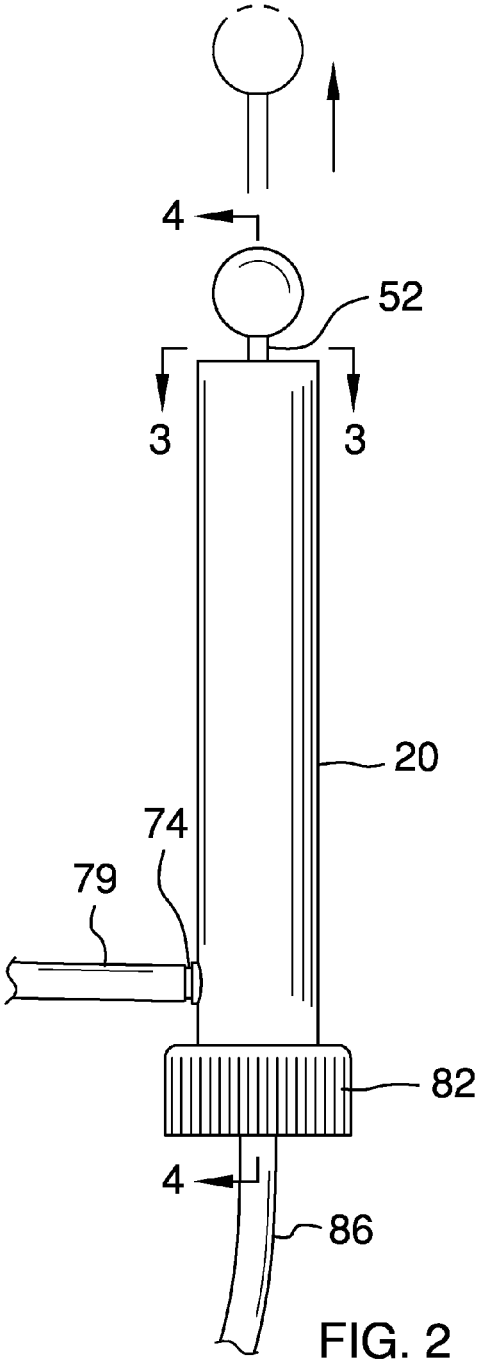
FIG. 2 is a lateral elevation view.
Figure 3:
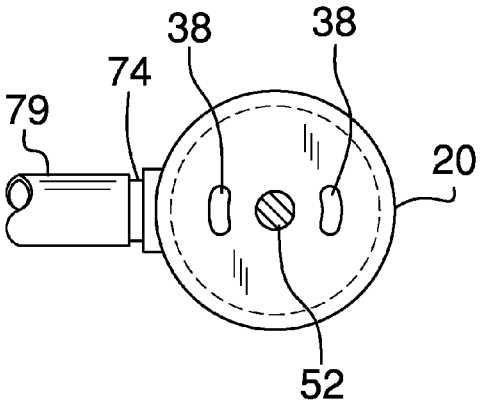
FIG. 3 is a bottom plan view of a barrier within a tube.
Figure 4:
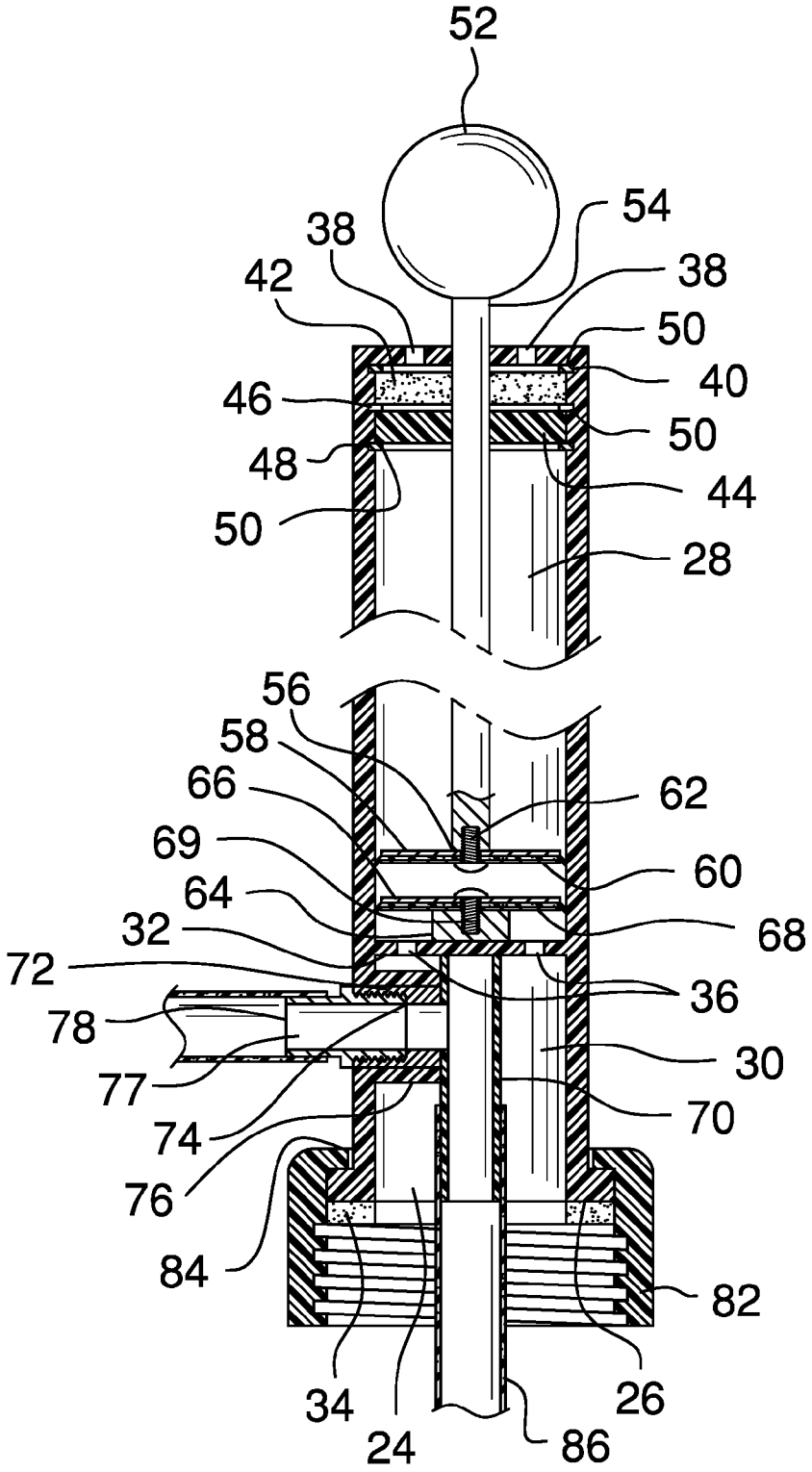
FIG. 4 is a cross sectional view of FIG. 4 taken along line 3-3.
Figure 5:
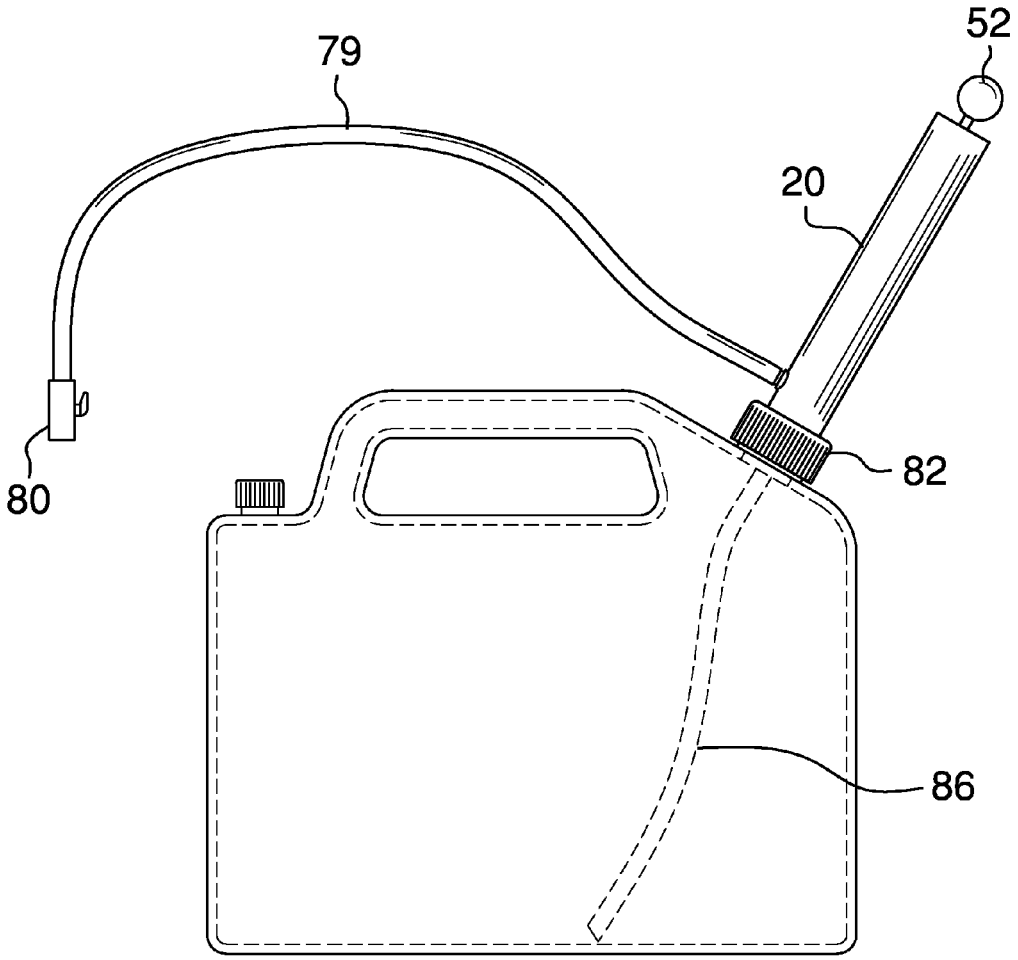
FIG. 5 is a cross sectional view of FIG. 2 taken along line 4-4.

With reference now to the drawings, and in particular FIGS. 1 through 5 thereof, an example of the fluid transfer hand pump employing the principles and concepts of the present fluid transfer hand pump and generally designated by the reference number 10 will be described.

Referring to FIGS. 1 through 5, the fluid transfer hand pump 10 has a tube 20 having a closed top end 22 spaced apart from an open bottom end 24. An outward flange 26 is disposed on the open bottom end 24. A first chamber 28 is disposed within the tube 20 proximal the closed top end 22. A second chamber 30 is disposed within the tube proximal the open bottom end 30. A barrier 32 divides the first chamber 28 from the second chamber 30. A plurality of air passages 36 is disposed within the barrier 32.

A rubberized grommet 34 is disposed on the outward flange 26. At least one vent 38 is disposed in the closed top end 22. A first groove 40 is disposed within the first chamber 28 adjacent the closed top end 22. An air filter 42 is disposed within the first chamber 28 adjacent the first groove 40. The vent 38 and the air filter 42 are in operational communication with the first chamber 28. A guide 44 is disposed within the first chamber 28 adjacent the air filter 42. A second groove 46 is disposed between the air filter 42 and the guide 44. A third groove 48 is disposed adjacent the guide 44 and distal the closed top end 22. Of a plurality of snap rings 50 provided, one of each snap ring 50 is disposed within each of the first groove 40, the second groove 46, and the third groove 48 wherein the air filter 42 and the guide 44 are configured to be removably retained.

A knobbed rod 52 is slidably disposed through the closed top end 22, the air filter 42, and the guide 44. The knobbed rod 52 has a distal end 54 disposed without the closed top end 22 and a proximal end 56 disposed within the first chamber 28. A first disc 58 is disposed on the proximal end 56. A first cupped seal 60 is disposed adjacent the disc 58. The first cupped seal 60 faces the open bottom end 24. The first cupped seal 60 is slidable within the first chamber 28. A first retainer 62 selectively retains the first cupped seal 60 and the first disc 58 to the proximal end 56.

A shoulder 64 is disposed on the barrier 32 within the first chamber 28. A second disc 66 is disposed atop the shoulder 64. A second cupped seal 68 is disposed between the second disc 66 and the shoulder 64. The second cupped seal 68 faces the barrier 32. A second retainer 69 selectively retains the second disc 66 and the second cupped seal 68 to the shoulder 64. A sleeve 70 is disposed continuously from the barrier 32 to the open bottom end 24. A collar 72 is disposed between the sleeve 70 and the tube 20. A hollow fitting 74 is disposed within the collar 72. The hollow fitting 74 has a threaded end 76 spaced apart from a second end 77 by an external lip 78. The threaded end 76 is disposed within the collar 72. The external lip 78 is selectively abutted to the tube 20.

A flexible first tubing 79 is fitted to the second end 77. A one-way valve 80 is disposed within the flexible first tubing 79 distal the hollow fitting 74. A threaded coupling 82 has an inward flange 84 slidably engaging the tube 20 and the outward flange 26. A flexible second tubing 86 is disposed on the sleeve 70. The threaded coupling 82 is configured to engage a fluid container. The rubberized grommet 34 is configured to seal the second chamber 30 to the fluid container. The second tubing 86 is configured to extend within the fluid container. The second tubing 86 is in operational communication with the first tubing 79. Forcing the knobbed rod 52 downwardly within the first chamber 28 is configured to capture air with the first cupped seal 60 and pass the air beyond the second cupped seal 68, through the plurality of air passages 36, and into the second chamber 30. The second cupped seal 68 substantially prevents air in the second chamber 30 from reentering the first chamber 28. The air within the second chamber 30 is configured to create an approximate two pounds per square inch of pressurized air within the container. The pressurized air within the container forces a fluid in the container through the second tubing 86, the sleeve 70, the collar 72, the one-way valve 80, and out of the first tubing 79.

The invention claimed is:

1. What is claimed is a fluid transfer hand pump comprising:

a tube having a closed top end spaced apart from an open bottom end;

an outward flange disposed on the open bottom end;

a first chamber disposed within the tube proximal the closed top end;

a second chamber disposed within the tube proximal the open bottom end;

a barrier dividing the first chamber from the second chamber, the barrier having a plurality of air passages;

a rubberized grommet disposed on the outward flange;

at least one vent disposed in the closed top end;

a first groove disposed within the first chamber adjacent the closed top end;

an air filter disposed within the first chamber adjacent the first groove;

wherein the vent and the air filter are in operational communication with the first chamber;

a guide disposed within the first chamber adjacent the air filter;

a second groove disposed within the first chamber between the air filter and the guide;

a third groove disposed within the first chamber adjacent the guide and distal the closed top end;

a plurality of snap rings, one of each snap ring of the plurality of snaps rings disposed within each of the first groove, the second groove, the third groove wherein the air filter and the guide are configured to be removably retained;

a knobbed rod slidably disposed through the closed top end, the air filter, the guide, the knobbed rod having a distal end disposed without the closed top end, a proximal end disposed within the first chamber;

a first disc disposed on the proximal end;

a first cupped seal disposed adjacent the disc, the first cupped seal facing the open bottom end, the first cupped seal slidable within the first chamber;

a first retainer selectively retaining the first cupped seal and the first disc to the proximal end;

a shoulder disposed on the barrier within the first chamber;

a second disc disposed atop the shoulder;

a second cupped seal disposed between the second disc and the shoulder, the second cupped seal facing the barrier;

a second retainer selectively retaining the second disc and the second cupped seal to the shoulder;

a sleeve disposed continuously from the barrier to the open bottom end;

a collar disposed between the sleeve and the tube;

a hollow fitting disposed within the collar;

a flexible first tubing fitted to the hollow fitting external the tube;

a threaded coupling having an inward flange slidably engaging the tube and the outward flange; and a flexible second tubing disposed on the sleeve;

wherein the threaded coupling is configured to engage a fluid container;

wherein the rubberized grommet is configured to seal the outward flange to the fluid container;

wherein the second tubing is configured to extend within the fluid container;

wherein the second tubing is in operational communication with the first tubing;

wherein forcing the knobbed rod downwardly within the first chamber is configured to capture air within the first chamber with the first cupped seal and pass the air beyond the second cupped seal, through the plurality of air passages, and into the second chamber;

wherein the second cupped seal substantially prevents air from reentering the first chamber from the second chamber;

wherein the air within the second chamber is configured to create an approximate two psi of pressurized air within the container; and wherein the pressurized air within the container forces a fluid in the container through the second tubing, the sleeve, and out of the first tubing.

2. What is claimed is a fluid transfer hand pump comprising:

a tube having a closed top end spaced apart from an open bottom end;

an outward flange disposed on the open bottom end;

a first chamber disposed within the tube proximal the closed top end;

a second chamber disposed within the tube proximal the open bottom end;

a barrier dividing the first chamber from the second chamber, the barrier having a plurality of air passages;

a rubberized grommet disposed on the outward flange;

at least one vent disposed in the closed top end;

a first groove disposed within the first chamber adjacent the closed top end;

an air filter disposed within the first chamber adjacent the first groove;

wherein the vent and the air filter are in operational communication with the first chamber;

a second groove disposed within the first chamber distal the first groove and adjacent the air filter;

a plurality of snap rings, one of each snap ring of the plurality of snaps rings disposed within each of the first groove and the second groove wherein the air filter is configured to be removably retained;

a knobbed rod slidably disposed through the closed top end and the air filter, the knobbed rod having a distal end disposed without the closed top end, a proximal end disposed within the first chamber;

a first disc disposed on the proximal end;

a first cupped seal disposed adjacent the disc, the first cupped seal facing the open bottom end, the first cupped seal slidable within the first chamber;

a first retainer selectively retaining the first cupped seal and the first disc to the proximal end;

a shoulder disposed on the barrier within the first chamber;

a second disc disposed atop the shoulder;

a second cupped seal disposed between the second disc and the shoulder, the second cupped seal facing the barrier;

a second retainer selectively retaining the second disc and the second cupped seal to the shoulder;

a sleeve disposed continuously from the barrier to the open bottom end;

a collar disposed between the sleeve and the tube;

a hollow fitting having a threaded end spaced apart from a second end by an external lip, the threaded end disposed within the collar;

a flexible first tubing fitted to the second end;

a one-way valve disposed within the flexible first tubing distal the hollow fitting;

a threaded coupling having an inward flange slidably engaging the tube and the outward flange; and a flexible second tubing disposed on the sleeve;

wherein the threaded coupling is configured to engage a fluid container;

wherein the rubberized grommet is configured to seal the outward flange to the fluid container;

wherein the second tubing is configured to extend within the fluid container;

wherein the second tubing is in operational communication with the first tubing;

wherein forcing the knobbed rod downwardly within the first chamber is configured to capture air within the first chamber with the first cupped seal and pass the air beyond the second cupped seal, through the plurality of air passages, and into the second chamber;

wherein the second cupped seal substantially prevents air from reentering the first chamber from the second chamber;

wherein the air within the second chamber is configured to create an approximate two psi of pressurized air within the container; and wherein the pressurized air within the container forces a fluid in the container through the second tubing, the sleeve, the collar, the one-way valve, and out of the first tubing.

* * * * *